US008684565B2

(12) United States Patent
Lopez et al.

(10) Patent No.: US 8,684,565 B2
(45) Date of Patent: Apr. 1, 2014

(54) LED LIGHT WITH ACTIVE THERMAL MANAGEMENT

(75) Inventors: Peter E. Lopez, Cary, NC (US); Curtis L. Progl, Raleigh, NC (US); Long Larry Le, Morrisville, NC (US)

(73) Assignee: Cree, Inc., Durham, NC (US)

( * ) Notice: Subject to any disclaimer, the term of this patent is extended or adjusted under 35 U.S.C. 154(b) by 183 days.

(21) Appl. No.: 13/292,605

(22) Filed: Nov. 9, 2011

(65) Prior Publication Data

US 2013/0114260 A1 May 9, 2013

(51) Int. Cl.
*F21V 29/00* (2006.01)

(52) U.S. Cl.
USPC ..... 362/294; 362/249.02

(58) Field of Classification Search
USPC ..... 362/249.02, 294, 249.01, 218
See application file for complete search history.

(56) References Cited

U.S. PATENT DOCUMENTS

2006/0193139 A1* 8/2006 Sun et al. ..... 362/373
2009/0147517 A1* 6/2009 Li et al. ..... 362/249.02
2010/0314985 A1 12/2010 Premysler
2011/0255283 A1* 10/2011 Dassanayake et al. ..... 362/235

* cited by examiner

*Primary Examiner* — Evan Dzierzynski
(74) *Attorney, Agent, or Firm* — Dennis J. Williamson; Moore & Van Allen PLLC

(57) ABSTRACT

A lamp comprises an LED assembly comprising at least a first LED operable to emit light. A heat sink for dissipating heat from the LED assembly comprises an active element and a passive heat conductive element. The active element may comprise a fan that forces air over the passive heat conducting element.

21 Claims, 6 Drawing Sheets

LED LIGHT WITH ACTIVE THERMAL MANAGEMENT

BACKGROUND

Light emitting diode (LED) lighting systems are an example of solid state lighting and have advantages over traditional lighting solutions such as incandescent and fluorescent lighting because they use less energy, are more durable, operate longer, and contain no lead or mercury. In many applications, one or more LED dies or chips are mounted within an LED package or on an LED module, which may make up part of a lighting unit, lamp, or bulb. The lighting system typically also includes one or more power supplies to power the LEDs.

SUMMARY

A lamp comprises an LED assembly comprising at least a first LED operable to emit light. A heat sink for dissipating heat from the LED assembly comprises an active element and a passive heat conductive element. The active element may comprise a fan that forces air over the passive heat conducting element.

The lamp may comprise power supply circuitry for powering the fan wherein the power supply circuitry powers the LED assembly. The power supply circuitry may comprise an AC/DC converter. The power supply circuitry may be connected to a source of power. The LED assembly may comprise at least one LED module mounted on a carrier. The heat sink may be in thermal contact with the LED assembly such that heat generated by the LED assembly is conducted to the heat sink. The passive heat conductive element may comprise a plurality of fins emanating from a central hub. The plurality of fins may extend radially from the hub. The hub may surround a solid core. An air passage or chamber may be formed in the hub. The air passage or chamber may be open towards one end of the heat sink such that air may flow into the air passage or chamber. An opening may be formed in the hub such that the air passage or chamber communicates with the space defined by the fins. The fan may force the air through the air passage or chamber. The air may be forced through the hub and into the area defined by the fins. A cover plate may isolate the fan from the exterior of the lamp and may comprise at least one hole to allow air to be drawn from the ambient environment to the air chamber by the fan. An enclosure for mixing the light emitted from the LED assembly may be provided.

A lamp comprises an LED assembly comprising at least a first LED operable to emit light through a mixing chamber, the LED assembly being connected to power supply circuitry. A heat sink for dissipating heat from the LED assembly comprises a passive heat conductive element where the passive heat conductive element comprises an air passage or chamber and a fan for forcing air through the air passage or chamber. The fan is connected to the power supply circuitry. The lamp may comprise a core disposed in the hub where the air passage or chamber is disposed between the hub and the core. A heat sink and a fan may be disposed in-line with the mixing chamber.

A method of making an LED lamp comprises providing at least a first LED assembly; connecting the LED assembly to power supply circuitry; thermally coupling a heat sink to the LED assembly comprising passive elements for transferring heat to the ambient environment; arranging at least one air flow passage for directing air over the passive elements; connecting a fan to the power supply circuitry that forces air through the at least one air flow passage.

DETAILED DESCRIPTION OF EMBODIMENTS OF THE INVENTION

Figure 1:
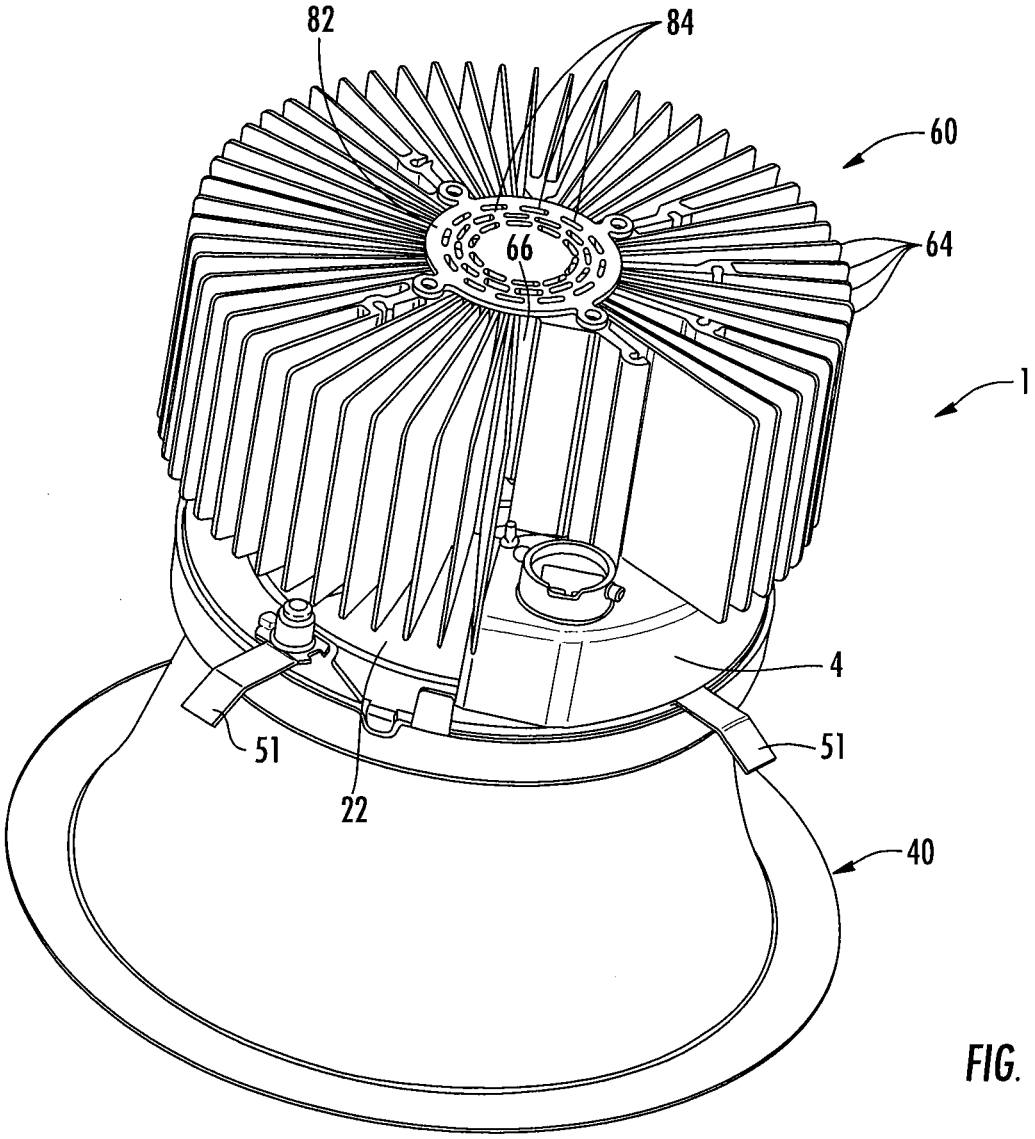
FIG. 1 is a perspective view of an embodiment of the lamp of the invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising", "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

Figure 2:
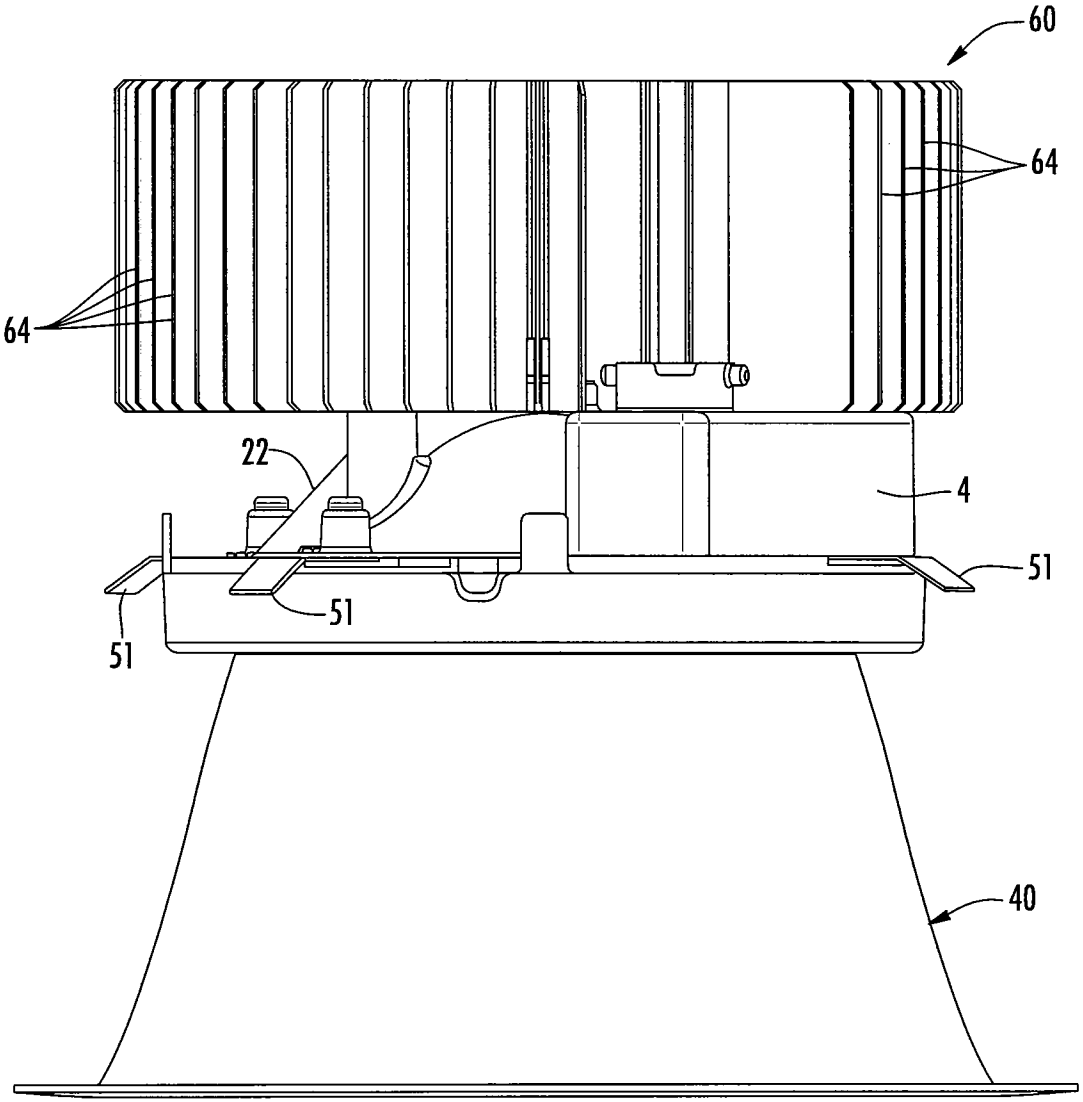
FIG. 2 is a side view of the lamp of FIG. 1.
Figure 3:
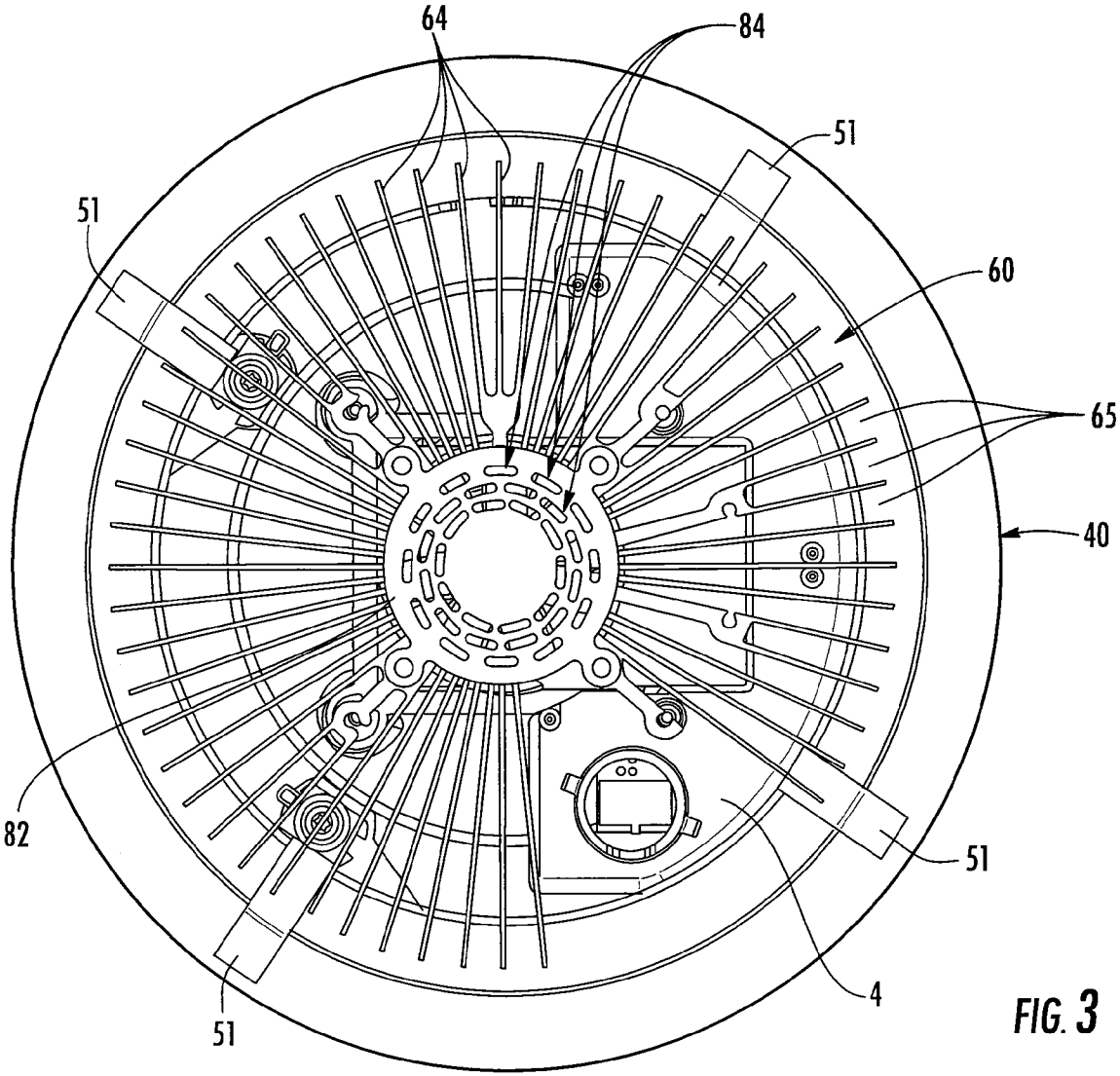
FIG. 3 is a top view of the lamp of FIG. 1.
Figure 4:
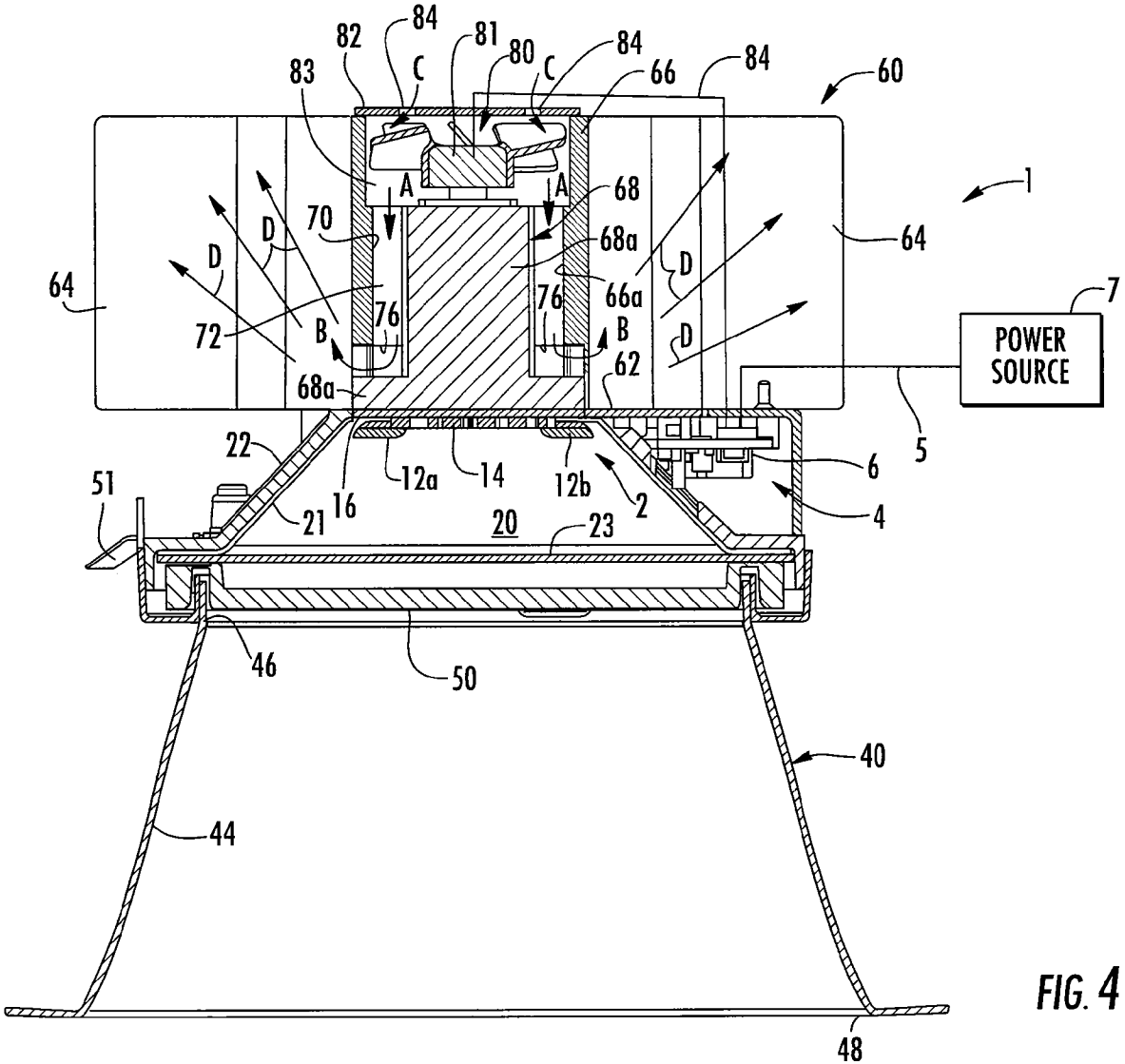
FIG. 4 is a section view of the lamp of FIG. 1 taken along line 4-4 of FIG. 3.
Figure 5:
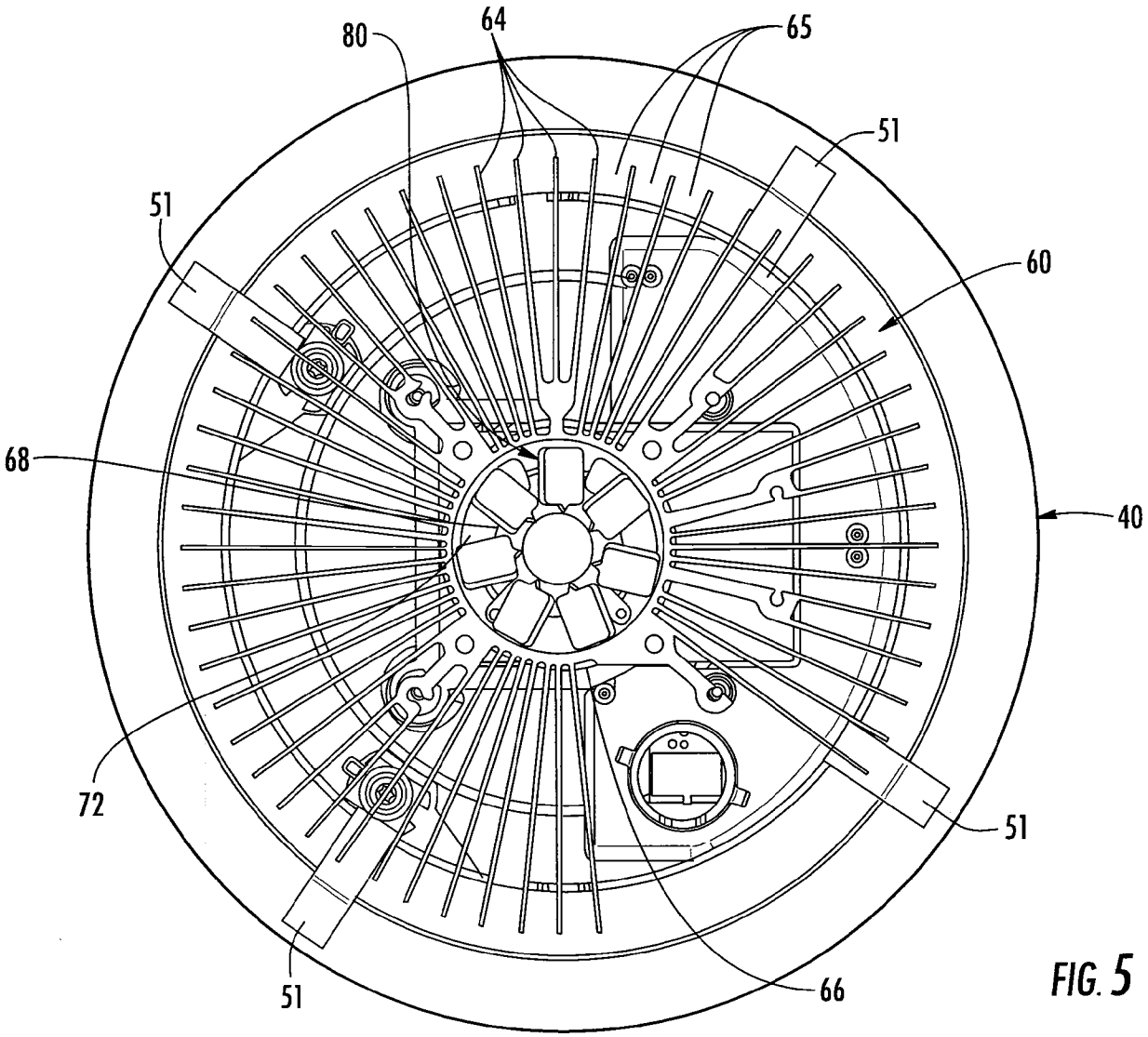
FIG. 5 is a top view of the lamp of FIG. 1 with the fan cover removed.
Figure 6:
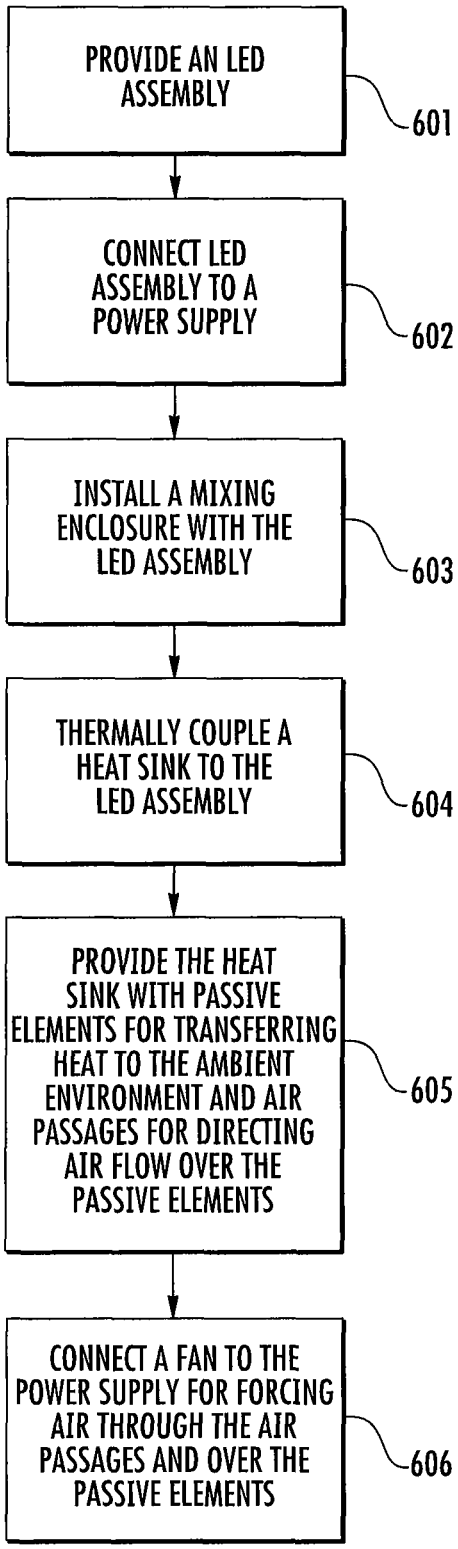
FIG. 6 is a block diagram illustrating an embodiment of a method of making the lamp of the invention.

Referring to FIGS. 1 through 5, an embodiment of a lighting unit, lamp, light bulb or bulb 1 (hereinafter referred to as "lamp") is shown. LED assembly 2 of the lamp 1 is shown interconnected with power supply portion 4 of the lamp. The power supply portion 4 of the lamp may comprise power supply circuitry 6 such as an AC/DC converter and/or other power supply circuitry to provide electric current to the LED assembly 2. Power may be provided to power supply portion 4 from an external source 7 such as a building's power supply. The power source 7 may be connected to the power supply circuitry 6 via a hard wired connection 5. The particular arrangement of the power supply portion 4 and power source 7 are examples only and any suitable power source may be used to power the lamp. Numerous types of LED lamps can be created using embodiments of the invention, with various types of bases, power supply portions and shapes.

LED assembly 2 further includes multiple LED modules 12*a*, 12*b* mounted on a carrier such as circuit board 14, which provides both mechanical support and electrical connections for the LED modules. The LED modules 12*a*, 12*b* comprise an LED chip or die that is encapsulated inside a package with a lens and leads that connect to power supply circuitry 6 for providing power to the chip or die. The LED assembly may also comprise a chip on a board. The circuit board 14 may be a printed circuit board with thermal vias. The LED assembly 2 may be held in place with screws or other mechanisms that secure the LED assembly 2 onto heat spreader 16 or other support structure. The heat spreader 16 may comprise any suitable material, such as aluminum, or structure that conducts heat. Voids may be provided in the heat spreader 16 to allow wires from the power supply circuitry 6 to be connected to the LED assembly 2.

LED assembly 2 in this example embodiment includes multiple LED modules 12*a*, 12*b*, in which an LED chip is encapsulated inside a package with a lens and leads. The LED modules 12*a*, 12*b* may comprise different types of LEDs and include LEDs operable to emit light of two different colors. For example, the LED modules 12*a* on the LED assembly 2 in the lamp of FIG. 1 may comprise blue LEDs, wherein each LED, when illuminated, emits light having peak wavelength from 430 nm to 490 nm and the LED modules 12*b* on the LED assembly 2 may comprise red LEDs, wherein each LED, when illuminated, emits red, orange or red/orange light having a dominant wavelength from 600 nm to 645 nm. In some embodiments LEDs of one type are packaged with a lumiphor. A lumiphor is a substance, which, when energized by impinging energy, emits light. Phosphor is an example of a lumiphor. In some cases, phosphor is designed to emit light of one wavelength when energized by being struck by light of a different wavelength, and so provides wavelength conversion. In the present example embodiment, the blue LEDs 12*a* in LED assembly 2 may be packaged with a yellow or green or orange phosphor or mixture of phosphors which, when excited by light from the included LED, emits light having a dominant wavelength from 530 nm to 590 nm. The phosphor may be deposited on the encapsulating lens for each LED at such a thickness so that some of the light from the LED goes through the phosphor, while other light is absorbed and the wavelength is converted by the phosphor.

Thus, each LED packaged in modules 12*a* forms a blue-shifted yellow (BSY) LED device, while the light from each LED packaged in modules 12*b* passes out of the LED module as red or orange or red/orange (R) light. Substantially white light can be produced when the two colors of light from the modules 12*a*, 12*b* in the LED assembly 2 are combined. Thus, this type of LED assembly may be referred to as a BSY+R LED assembly and produces white light with a high color rendering index (CRI). In addition to a BSY+R LED assembly the LED assembly may comprise a blue shifted LED device such as a blue shifted green (BSG) LED device or blue shifted red (BSR) LED device mixed with another color to produce emitted light of a suitable color such as white. The device may also use a phosphor globe excited by a combination of blue, red and BSY LED devices.

It should be noted that other arrangements of LEDs can be used with embodiments of the present invention. For example, a UV LED coated with red/blue/green phosphor; red/green/blue LEDs with no phoshors; blue/blue-yellow LEDs and others may be used. The same or varying numbers of each type of LED can be used, and the LED packages can be arranged in varying patterns. A single LED or multiple LEDs of each type could be used. Additional LEDs, which produce additional colors of light, can be used. Lumiphors can be used with some or all the LED modules. Multiple LED chips may be included in one, some or all of the LED modules. A further detailed example of using groups of LEDs emitting light of different wavelengths to produce substantially white light can be found in issued U.S. Pat. No. 7,213,940, which is incorporated herein by reference in its entirety.

The lamp 1 further comprises a color mixing enclosure 20 defined at least in part by housing 22. A light reflective surface 21 may be provided on the inside of the housing 22 to enhance the reflectivity of the enclosure. The enclosure 20 may provide color mixing so that color hot spots do not appear in the light pattern being emitted from the lamp and the light emitted from the lamp is a uniform color such as white light. The housing 22 may also act as a heat sink such that some of the heat generated by the LED assembly is dissipated through the housing 22. In the embodiment of the lamp illustrated in the figures, the enclosure 20 is formed as a conical or parabolic reflector that generates a directional wide light pattern. The LED assembly 2 is positioned at one end of the enclosure 20 with a diffuser lens 23 positioned across the opening at the opposite end of the housing 22 to diffuse the light emitted from the enclosure in a desired pattern. Clips 51 may be provided on the housing 22 to hold the lamp in a recessed light box.

A trim piece 40 may be attached to the lamp 1 to create an integral lamp assembly for use in a recessed light application such as retrofitting an existing light opening. The trim piece 40 may be made of plastic, metal or a combination of materials. If the trim piece 40 is made of all-metal, or other thermally conductive material, the trim piece 40 may also act as an additional heat sink for the LEDs. While the trim piece 40 may be made of a thermally conductive material, an all-plastic trim piece may also be used if desired. In one embodiment, the trim piece 40 comprises a dome 44 having an opening 46 on its top end dimensioned to receive the distal end of lamp 1 and an opening 48 on its bottom end through which light from the lamp 1 is emitted. A transparent cover 50 may be used to cover the lamp components.

In addition to the thermal management properties of the housing 22 and trim piece 40, thermal management in the illustrated lamp is accomplished using an active thermal management system. A heat sink 60 is provided in thermal contact with the LED assembly 12 such that heat generated by the LED assembly 12 is conducted to the heat sink 60 and dissipated to the ambient environment. The heat sink 60 may be in direct physical and thermal contact with the LED assembly 12 or the heat sink 60 may be in thermal contact with the LED assembly 12 via intermediary elements such as a heat spreader 62 or both. In the illustrated embodiment the heat sink 60 comprises a passive element comprising a plurality of fins 64 emanating from a central hub 66 separated by air passages or spaces 65. In the illustrated embodiment the fins 64 extend radially from the hub 66 to define a generally cylindrical heat sink that fits into a recessed can light aperture or box although the heat sink 60 may have any suitable shape. For example, the fins do not have to be of all the same length and width. The hub 66 surrounds a solid core 68. The passive element may have other heat transferring elements than the illustrated fins.

The fins 64, hub 66 and core 68 may be made of a thermally conductive material such as aluminum although any thermally conductive material may be used. In one embodiment the hub 66 and fins 64 are extruded from aluminum where the hub 66 comprises a centrally located bore 70 that extends through the heat sink. The core 68 comprises a separate piece that is fixed in the bore 70 to complete the passive element of the heat sink. The core 68 may be cast of aluminum or other thermally conductive material. While the fins 64 and hub 66 are made separate from the core 68 for ease of manufacturing the fins 64, hub 66 and core 68 may be made of a single unitary part. Moreover, the fins 64 may be made separate from the hub 66 and secured thereto if desired. The fins 64, core 68 and hub 66 are in thermal conductive contact with one another and form an integral passive heat dissipating element.

The core 68 comprises a main portion 68*a* that fits into the bore 70 but has a smaller cross-sectional dimension than the bore 70 such that an open space is created between the core 68 and the hub 66. The open space defines an air passage or chamber 72 as will be described. The terms passage and chamber are used herein to mean a space through which air may flow where the flow of air dissipates heat from the passive heat sink element that define, at least in part, the passage or chamber. In one embodiment the core 68 and hub 66 are cylindrical such that air passage or chamber 72 is an annular cavity surrounding the core 68. While the passage 72 is shown as a single open annular space surrounding the core 68, the hub 66 the core 68 may be shaped such that the air flow chamber comprises a plurality of independent air flow channels between the core 68 and the hub 66. The air passage 72 is open towards the top of the heat sink such that air may flow into the top of the passage 72 as represented by arrows A. The bottom of the air passage 72 is closed. In the illustrated embodiment the core 68 comprises a lower annular flange 68*a* that is dimensioned to close the bottom of air passage 72. An opening 76 is formed in the wall 66*a* of hub 66 such that the air passage 72 communicates with the space defined by the fins 64. The air passage 72 may take a wide variety of shapes provided air is directed over the passive heat sink elements.

A fan 80 is located above the core 68 such that when the fan 80 is activated the rotation of the fan blades draws air from above the lamp and forces the air downward into the air passage 72, as represented by arrows C. The fan creates directional air flow over the passive heat sink elements. The term fan as used herein means any powered device that is capable of creating an air flow from the ambient environment through the air passage 72. Further, multiple fans may be used to cause the flow of air through the heat sink. The fan 80 may be located in a space 83 defined in hub 66 disposed over the core 68 and air passage 72. The air is forced past the core 68 and the hub 66 and out of opening 76 and into the area defined by the fins 64, as represented by arrows B. The air flows in the passages or spaces 65 between the fins 64 and passes over the fins 64, as represented by arrows D. The flow of air over the core 68, hub 66 and fins 64 increases the transfer of heat from these elements to the ambient environment. The fan 80 may be powered by the same power source 7 and power supply circuitry 6 that powers the LED assembly 12 and a hard wire connection 84 may be made from the power supply circuitry to the fan motor 81. A separate power source may also be used to power the fan 80. A cover plate 82 may be provided over the fan 80 to isolate the fan from the exterior of the lamp. The cover plate 82 is provided with through holes 84 to allow air to be drawn from the ambient environment to the air chamber by the fan 80. The LED assembly 2, mixing chamber 20 and the heat sink 60 are arranged vertically in-line with one another such that the lamp 1 has a vertically stacked arrangement that fits into recessed light openings. In the illustrated embodiment the chamber 20, LED assembly 2, the passive heat sink elements 64, 66 and the fan 80 are arranged substantially coaxially.

When the lamp is turned on to power LED assembly 2 the fan 80 is also powered. The fan 80 draws air from the ambient environment, as represented by arrows C, and forces air into the top of the air passage 72, as represented by arrows A. The air flows down the air passage 72 and exits the bottom of the air passage through opening 76, as represented by arrows B. When the air exits the air passage 72 the air flows in the passages 65 between the fins 64, as represented by arrows D. As the air flows around the core 68 and past the fins 64 the air flow increases the transfer of heat from the heat sink to the ambient air to thereby facilitate dissipation of heat from the LED assembly 2.

A method of making an LED lamp comprises providing at least a first LED assembly (Block 601). The LED assembly is connected to a power supply (Block 602). A mixing enclosure with an internal reflector wall and a diffuser lens is installed with the LED assembly and is configured so that at least some light emitted by the LED assembly exits the LED lamp from the enclosure through the diffuser lens (Block 603). A heat sink is thermally coupled to the LED assembly (Block 604). The heat sink is provided with passive elements for transferring heat to the ambient environment and air passages for directing air flow over the passive elements (Block 605). A fan is connected to the power source that forces air through the air passages and over the passive heat sink elements (Block 606).

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A lamp comprising:

an LED assembly comprising at least a first LED operable to emit light;

a heat sink for dissipating heat from the LED assembly comprising a passive heat conductive element comprising a plurality of fins emanating from a central hub wherein the hub surrounds a solid core;

a fan for forcing air over the passive heat conducting element.

2. The lamp of claim 1 further comprising a power supply circuitry for powering the fan wherein the power supply circuitry powers the LED assembly.

3. The lamp of claim 2 wherein the power supply circuitry comprises an AC/DC converter.

4. The lamp of claim 2 wherein the power supply circuitry is connected to a source of power.

5. The lamp of claim 1 wherein the LED assembly comprises at least one LED module mounted on a carrier.

6. The lamp of claim 1 wherein the heat sink is in thermal contact with the LED assembly such that heat generated by the LED assembly is conducted to the heat sink.

7. The lamp of claim 1 wherein the plurality of fins extend radially from the hub.

8. The lamp of claim 1 wherein an air passage is formed in the hub.

9. The lamp of claim 8 wherein the air passage is open towards one end of the heat sink such that air may flow into the air passage.

10. The lamp of claim 8 wherein an opening is formed in the hub such that the air passage communicates with the plurality of fins.

11. The lamp of claim 8 wherein the fan forces the air through the air passage.

12. The lamp of claim 1 wherein the air is forced through the hub and over the plurality of fins.

13. The lamp of claim 1 wherein a cover plate isolates the fan from the exterior of the lamp.

14. The lamp of claim 13 where at least one hole is provided in the cover plate to allow air to be drawn from the ambient environment to the air chamber by the fan.

15. The lamp of claim 1 further comprising an enclosure for mixing the light emitted from the LED assembly.

16. The lamp of claim 1 further comprising a trim piece to create an integral lamp assembly.

17. A lamp comprising:

an LED assembly comprising at least a first LED operable to emit light through a mixing chamber, the LED assembly being connected to a power supply circuitry;

a heat sink for dissipating heat from the LED assembly comprising a passive heat conductive element, the passive heat conductive element comprising an air passage and a core disposed in a hub where the air passage is disposed between the hub and the core; and a fan for forcing air through the air passage, the fan being connected to the power supply circuitry.

18. The lamp of claim 17 wherein the heat sink is disposed in-line with the mixing chamber.

19. The lamp of claim 17 wherein the fan is disposed in-line with the mixing chamber.

20. A method of making an LED lamp comprising:

providing at least a first LED assembly;

connecting the LED assembly to power supply circuitry;

thermally coupling a heat sink to the LED assembly comprising passive elements for transferring heat to the ambient environment and a core disposed in a hub;

arranging at least one air flow passage for directing air over the passive elements where the air passage is disposed between the hub and the core;

connecting a fan to the power supply circuitry that forces air through the at least one air flow passage.

21. A lamp comprising:

an LED assembly comprising at least a first LED operable to emit light;

a heat sink for dissipating heat from the LED assembly comprising a passive heat conductive element comprising a plurality of fins emanating from a central hub where the plurality of fins are exposed to the exterior of the lamp and an air passage is formed in the hub wherein the air passage is open, and an opening is formed in the hub such that the air passage communicates with the plurality of fins;

a fan for forcing air through the air passage to the passive heat conducting element.

* * * * *